United States Patent [19]

Suzuki et al.

[11] 4,345,431

[45] Aug. 24, 1982

[54] EXHAUST GAS CLEANING SYSTEM FOR DIESEL ENGINES

[75] Inventors: Yoshinobu Suzuki, Narashinoshi; Kiyoshi Chiba, Machidashi; Tomoya Tukuhiro, Kanagawa; Yoshiyuki Iwasawa, Tokyo; Yasuo Kajioka, Tokyo; Tomio Komine, Tokyo, all of Japan

[73] Assignee: Shimizu Construction Co. Ltd., Tokyo, Japan

[21] Appl. No.: 194,244

[22] PCT Filed: Jul. 26, 1979

[86] PCT No.: PCT/JP79/00194

§ 371 Date: Mar. 25, 1980

§ 102(e) Date: Mar. 25, 1980

[87] PCT Pub. No.: WO80/00362

PCT Pub. Date: Mar. 6, 1980

[51] Int. Cl.[3] ..... F01N 3/28; F01N 3/38

[52] U.S. Cl. ..... 60/286; 60/295; 60/297; 60/303; 422/183

[58] Field of Search ..... 60/297, 295, 296, 286, 60/303, 279; 422/180, 183

[56] References Cited

U.S. PATENT DOCUMENTS

| | | | |
|---|---|---|---|
| 2,898,202 | 8/1959 | Houdry | 60/296 |
| 2,946,651 | 7/1960 | Houdry | 60/296 |
| 3,306,035 | 2/1967 | Morrell | 60/303 |
| 3,503,716 | 3/1970 | Berger | 60/297 |
| 4,054,418 | 10/1977 | Miller | 60/297 |

FOREIGN PATENT DOCUMENTS

| | | | |
|---|---|---|---|
| 2530822 | 1/1977 | Fed. Rep. of Germany | 60/297 |
| 1443886 | 5/1966 | France | 60/297 |

*Primary Examiner*—Douglas Hart
*Attorney, Agent, or Firm*—Martin Smolowitz

[57] ABSTRACT

Heat-resistant filters 6, 7 are disposed at the upstream side of a catalyst bed 9. These heat-resistant filters 6, 7 perform filtration to completely catch and remove the smoke particles suspended by the exhaust gas, so that the undesirable attaching of the smoke particles to the catalyst bed 9 is fairly avoided. Also, means are provided to regenerate the heat-resistant filters simply by burning the smoke particles attaching to these filters. In another embodiment, a heat-resistant filter 24 and a catalyst bed 26 are shaped to have hollow cylindrical forms and are superposed to each other. For regenerating the heat-resistant filter 24, hot air is introduced into the filter 24 by the action of a high pressure burner 28 or a vacuum generating section 33. The heat-resistant filter 24 and the catalyst bed 26 are accomodated by a single case 21.

2 Claims, 5 Drawing Figures

EXHAUST GAS CLEANING SYSTEM FOR DIESEL ENGINES

DESCRIPTION

1. Technical Field

The present invention relates to an exhaust gas cleaning system for diesel engines mounted on construction equipments or ordinary vehicles such as diesel buses and trucks or for diesel engines installed in buildings. More particularly, the invention is concerned with an exhaust gas cleaning system for diesel engines, capable of ensuring for a long period of time the removal of smoke particles and noxious components, as well as bad smell, of the exhaust gas emitted from the diesel engine.

2. Background Art

Hitherto, there have been proposed and used various exhaust gas cleaning systems for diesel engines the typical examples of which are shown below.

(a) a system having a combination of a smoke removal device such as a cyclone and a catalyst bed disposed in the passage of the exhaust gas emitted from the diesel engine.

(b) a system in which the exhaust gas is blown into water or a system having a combination of water-scrubbing type smoke removal device adapted to atomize and spray scrubbing water into the exhaust gas and a catalyst bed.

The inertia type dust collecting device such as the cyclone of the above-mentioned system (a), however, is effective only for dust particles having particle sizes of greater than several microns, and cannot be used effectively for catching smoke particles having smaller particle sizes. Generally, the smoke particles of the exhaust gases emitted from the diesel engine are too small to be caught by the inertia type dust collecting device. Thus, it is not possible to satisfactorily catch the smoke particles of the exhaust gas from diesel engines, with the cyclone. As a result, carbon particles of the smoke are inconveniently attached to the surface of the catalyst during long use to deteriorate the function of the catalyst to make it impossible to effectively remove the bad smell and noxious components such as carbon monoxide and hydrocarbon. To regenerate this catalyst, it is necessary to heat it up to a high temperature which is not only troublesome but also causes a deterioration of the catalytic function, as well as distortion or breakdown of the catalyst.

On the other hand, in the above-mentioned conventional system (b), the water-scrubbing type smoke removing device can remove the smoke satisfactorily. However, as a result of the supply of the water, a large amount of steam is generated to seriously hinder the visibility. Further, troublesome maintenance work such as supply of the scrubbing water and so forth is required.

For completely removing the bad smell and the noxious components of the exhaust gas, it is necessary that the exhaust gas has a high temperature of between 300° C. and 500° C. at the catalyst inlet. However, in the system (b) above, the exhaust gas temperature is inconveniently lowered as the exhaust gas is scrubbed with the water by the water-scrubbing type smoke removing device. For this reason, it is not allowed to install the catalyst at the downstream side of the water-scrubbing type smoke removing device. Consequently, the smoke particles are inevitably attached to the catalyst, resulting in various problems which have been described before in connection with the drawbacks of the conventional system (a).

It is, therefore, an object of the invention to provide an exhaust gas cleaning system for diesel engines, capable of maintaining a high efficiency of exhaust gas cleaning for a long period of time, by removing the smoke particles without fail by a heat-resistant filter disposed at the upstream side of the catalyst bed, thereby to overcome above described problems of the prior art.

It is another object of the invention to provide an exhaust gas cleaning system for diesel engines, in which the construction for burning and removing the smoke particles which have been caught by the heat-resistant filter as the latter is passed by the exhaust gas is highly simplified.

DISCLOSURE OF THE INVENTION

According to the invention, an exhaust gas cleaning system for diesel engines has an exhaust gas cleaning passage for cleaning the exhaust gas emitted from a diesel engine, a heat-resistant filter disposed at the upstream side portion of the exhaust gas cleaning passage, a catalyst convertor adapted to remove the bad smell and noxious components of the exhaust gas and disposed at the downstream side portion of the exhaust gas cleaning passage, and a regenerating device annexed to the heat-resistant filter and adapted to burn and remove the smoke particles which have been caught by the heat-resistant filter.

In this arrangement, the undesirable attaching of the smoke particles to the catalyst bed is effectively prevented by the filtration performed by the heat-resistant filter, so that a good cleaning performance is ensured for a long period of time. At the same time, the smoke particles caught by the heat-resistant filter can easily be burnt and removed by the regenerating device.

The heat-resistant filter of the above-explained improved cleaning system of the invention is designed and constructed such that the burning and removal of the smoke particles caught by the heat-resistant filter can be effected even during the flowing of the exhaust gas through the heat-resistant filter. In consequence, the exhaust gas cleaning system for diesel engines in accordance with the invention is made small-sized and compact.

BRIEF DESCRIPTION OF THE DRAWINGS

FIGS. 2 to 5 in combination show another embodiment in which;

FIG. 2 is a longitudinal sectional view of an exhaust gas cleaning device;

FIG. 3 is a sectional view taken along the line A—A of FIG. 1; and

FIGS. 4 and 5 show practical forms for carrying out this embodiment.

BEST MODE FOR CARRYING OUT THE INVENTION

The invention will be more fully understood from the following description taken in conjunction with the accompanying drawings.

Figure 1:
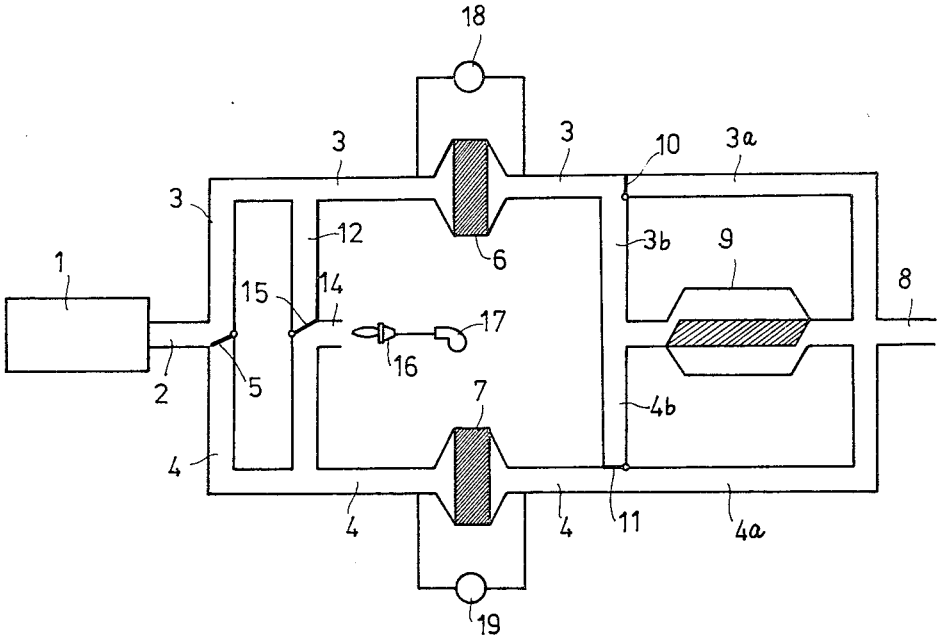
FIG. 1 is a block diagram of an exhaust gas cleaning system for diesel engines, constructed in accordance with a practical embodiment of the invention.
Figure 2:
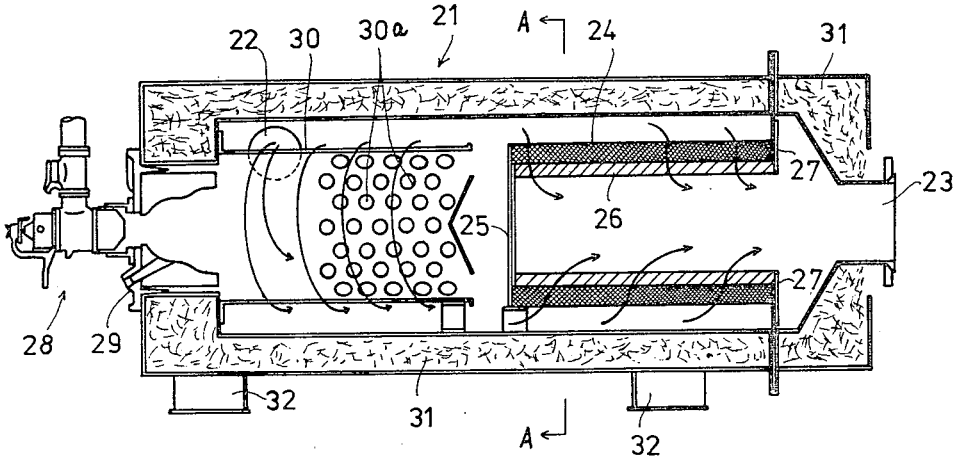
Figure 3:
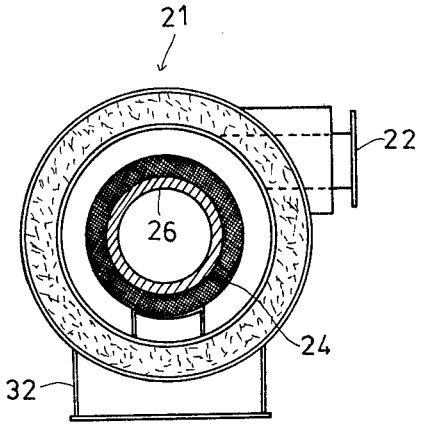

Referring first to FIG. 1, a reference numeral 1 denotes a diesel engine having an exhaust gas cleaning system of the invention. A reference numeral 2 denotes a starting end of an exhaust gas cleaning passage, to which connected are two shunt passages 3, 4. A change-over valve 5 is disposed at the point where the shunt passages 3 and 4 merge in each other, so that the flow of the exhaust gas is switchable between the passage 3 and the passage 4 depending on the state of the change-over valve 5.

Reference numerals 6 and 7 denote, respectively, heat-resistant filters disposed in the shunting passages 3 and 4, respectively. The heat-resistant filters 6 and 7 are made of metal fibers of several different fiber diameters selected in accordance with the particle-size distribution of the smoke. The metal fibers of different fiber diameters are shaped into layers which are superposed or laminated to present a generally cylindrical or disc-like form as a whole.

Passages 3*a*, 3*b* and passages 4*a*, 4*b* branch from the passages 3 and 4, respectively. The passages 3*a* and 4*a* lead to an exhaust pipe 8, while the passages 3*b* and 4*b* are communicated with a catalyst convertor 9 the outlet side of which is in communication with the exhaust pipe 8. Reference numerals 10 and 11 denote change-over valves disposed in the branch pipes 3*a*, 3*b* and the branch pipes 4*a*, 4*b*, respectively. The arrangement us such that, as the change-over valves 10 and 11 are operated, the state of communication is switchable between a first mode in which the branching pipes directly communicate with the exhaust pipe 8 and a second mode in which these branch pipes 3, 4 are communicated with the catalyst convertor 9.

Reference numerals 12 and 13 denote regenerating passages extended between the branch passages 3 and 4. These regenerating passages 12 and 13 are connected to the inlet sides of the heat-resistant filters 6 and 7. Further, a change-over valve 15 is disposed at the blow-in port 14 of the regenerating passages 12, 13 so as to be confronted by a burner 16. The arrangement is such that, the smoke particles with which the heat-resistant filters 6, 7 are clogged are burnt and removed as hot air is introduced into the filters 6 and 7 by means of the blower 17. The regenerating device for regenerating the heat-resistant filters 6 and 7 are thus constructed. Since the exhaust gas emitted from the diesel engine contains only a small amount of oxygen, it is extremely difficult to burn the smoke particles. A blower 17 is therefore provided for supplying external air to assist the complete burning of the smoke particles.

Reference numerals 18 and 19 denote pressure differential gauges attached across respective heat-resistant filters 6 and 7. More specifically, the pressure differential gauge 18 is communicated with the outlet and inlet sides of the heat-resistant filter 6, while the pressure differential gauge 19 is communicated with the outlet and inlet sides of the heat-resistant filter 7. These pressure differential gauges are adapted to inform of the pressure differential or pressure drop across respective heat-resistant filters 6, 7, i.e. the state of clogging of these filters with the smoke particles.

Although not shown, an automatic control is adopted to automatically reverse or inverse the change-over valves 5, 10, 11, 15 to switch the passage of the exhaust gas and to automatically start the burner 16 and the blower 17 thereby to feed hot air into the heat-resistant filters 6, 7 to burn and remove the smoke particles attaching to these filters. This automatic control is made in accordance with the state of clogging of the heat-resistant filters 6, 7 sensed by the pressure-differential gauges 18 and 19.

In the exhaust gas cleaning system of the invention having the described construction, assuming here that the diesel engine has been started with the change-over valves 5, 10, 11, 15 taking the illustrated positions, the exhaust gas emitted from the diesel engine 1 is made to flow into the branch passage 3 through the starting end of the exhaust cleaning passage 2 and then flows through the heat-resistant filter 6 to reach the catalyst convertor 9 via the branch passage 3*b*. The exhuast gas is finally relieved to the atmosphere through the exhaust pipe 8. It is to be noted that, since the catching of the smoke particles relies upon the filtration performed by the heat-resistant filter 6, it is possible to catch even comparatively small smoke particles without fail, so that the smoke particles suspended by the exhaust gas is completely removed. On the other hand, the noxious components such as carbon monoxide and hydrocarbon of the exhaust gas and the bad smell are decomposed into harmless carbon dioxide due to the catalytic oxidation action of the catalyst filling the catalyst convertor 9. In this connection, it is to be noted that the undesirable attaching of the smoke particles to the catalyst convertor 9 is fairly avoided because the smoke particles have been already caught and removed by the heat-resistant filter 6, so that the catalytic action of the catalyst is maintained for longer period of time without deterioration.

The attaching or deposition of the smoke particles to the heat-resistant filter 6 appears as the increase of the pressure loss across the heat-resistant filter 6. This increase is conveniently detected by the pressure differential gauge 18 which in turn acts to cause an automatic inversion of the change-over valves 5, 10, 11, 15 to switch the passage to make the exhaust gas flow through the branch passage 4 and, hence, the heat-resistant filter 7, thereby to permit a continuous cleaning. At the same time, the burner 16 and the blower 17 are automatically started to supply the hot air to the heat-resistant filter 6 which has been clogged with the smoke particles, thereby to completely burn the smoke particles which have been caught by the heat-resistant filter 6 to regenerate the latter in a comparatively short period of time.

The gases generated during the regeneration of the heat-resistant filter is discharged directly through the exhaust pipe 8, via the branch passage 3.

After the completion of the regeneration, the pressure drop across the heat-resistant filter 6 is reduced. This reduction is effectively sensed by the pressure differential gauge 18 which in turn produces a signal for stopping the burner 16 and the blower 17.

In the described embodiment, the heat-resistant filters are arranged in two parallel lines, to permit a switching such that one line operates while the other line is being regenerated. This arrangement, however, is not exclusive and it is possible to make the exhaust gas cleaning system small-sized and compact by using only one line of the heat-resistant filter and arranging such that the exhaust gas is allowed to flow through the sole heat-resistant filter even during the regeneration of the latter.

Hereinafter, another embodiment of the invention having only one line of the heat-resistant filter will be described with reference to FIGS. 2 to 5.

A reference numeral 21 denotes a cylindrical hollow case disposed in the exhaust system of a diesel engine. An inlet 22 for the exhaust gas is formed in the peripheral wall of the case 21 at a portion close to one axial end of the latter, while an outlet 23 for the exhaust gas is formed near the other axial end of the case 21. The case 21 accommodates a heat-resistant filter 24 which is constituted by metallic fibers or the like material shaped into the form of a mat or sheet and wound in a spiral manner into a hollow cylindrical form. As is the case of the heat-resistant filter of the first embodiment, this heat-resistant filter 24 of the second embodiment is composed of metal fibers of different fiber diameters suitably selected in accordance with the particle-size distribution of the smoke particles.

The axial end portion of the heat-resistant filter 24 closer to the inlet 22 is closed by a cover 25 while the end of the same closer to the outlet 23 is left opened and communicated with the outlet 23.

A reference numeral 26 denotes a catalyst bed disposed in the case 21. This catalyst bed 26 is constituted by sponge-shaped metal catalyst wound spirally into a hollow cylindrical form. The metal catalyst is typically platinum or the like material capable of removing the bad smell and noxious components of the exhaust gas, e.q. carbon monoxide and hydrocarbon. The catalyst bed 26 is disposed in the hollow cylindrical heat-resistant filter 24, i.e. at the downstream side of the same, and underlies the heat-resistant filter 24.

A reference numeral 27 denotes a partition plate which is disposed near the outlet 23 of the case 21 and is adapted to separate the inlet 22 and the outlet 23 of the case 21 from each other. Therefore, the exhaust gas coming into the case 21 through the inlet 22 is allowed to reach the outlet 23 only through the cylindrical peripheral surfaces of the heat-resistant filter 24 and the catalyst bed 26.

A high pressure burner is attached to one axial end of the case 21 closer to the inlet 22 in an airtight manner. The high pressure burner 28 is adapted to be actuated in accordance with the pressure differential across the laminated layers of the heat-resistant filter 24 and the catalyst bed 26 or the pressure differential between the inlet 22 and outlet 23 of the case 23, i.e. the state of clogging of the heat-resistant filter 24 which is sensed by a pressure-differential gauge (not shown). Thanks to the high withstandable pressure, this high pressure burner 28 can operate even during running of the diesel engine, i.e. during flowing of the exhaust gas through the heat-resistant filter 23. Thus, the burner 28 can supply the hot air to the heat-resistant filter 24 even under the pressure of the flow of exhaust gas to regenerate the heat-resistant filter 24.

A reference numeral 29 denotes an intake port for high pressure combustion air, provided in the high pressure burner 28. The high pressure burner 28 is provided necessary means for coping with the fluctuation of the pressure of the exhaust gas introduced into the case 21. A reference numeral 30 denotes a cylindrical heat radiating plate attached to the high pressure burner 28 and adapted to surround the flame formed around the high pressure burner 28. A multiplicity of apertures 30*a*, 30*a* . . . are formed in the peripheral wall of the heat radiating plate near the free end of the same. Reference numerals 31 and 32 denote, respectively, a heat insulating material attached to the case 21 and a fixture for mounting the case 21.

Figure 4:
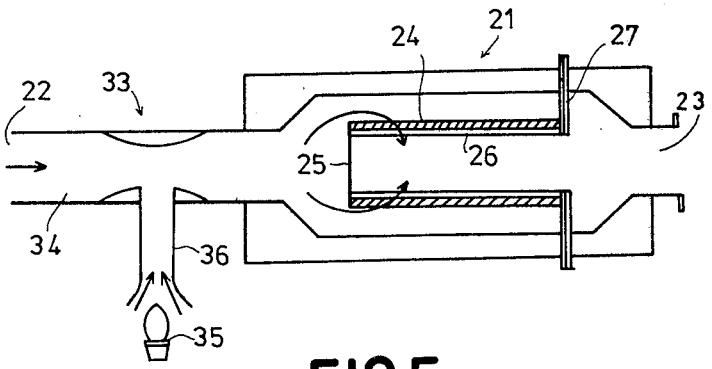
Figure 5:
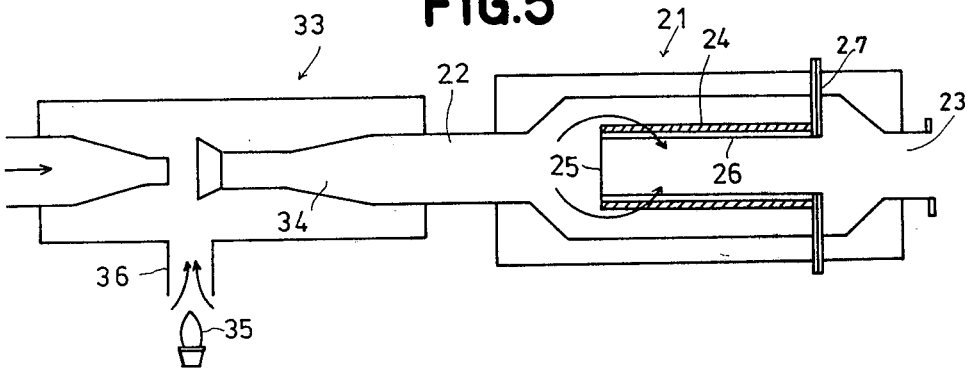

FIGS. 4 and 5 show another form of this second embodiment. In the described second embodiment having only one heat-resistant filter, the device for regenerating the heat-resistant filter 24 is constituted by the high pressure burner 28. In this another form of the embodiment, however, the high pressure burner 28 is substituted by a combination of an ordinary low pressure burner and a vacuum generating section formed in the exhaust gas discharge passage. Namely, these low pressure burner and the vacuum generating section constitutes the device for regenerating the heat-resistant filter 24. The vacuum generating section formed in the exhaust passage 34 upstream from the case 21 is designated at a reference numeral 33. This vacuum generating section can be formed by locally reducing the diameter of the exhaust passage 34 as shown in FIG. 4, or by separating the exhaust passage 34 into two sections and differentiating the diameters of opposing portions of the exhaust passage 34, as shown in FIG. 5. The low pressure burner 35 is disposed to confront to a conduit 34 which opens to the vacuum generating section 33, so that the hot air produced by the low pressure burner 35 is induced into the case 21 due to the vacuum which is generated as the exhaust gas flows through the vacuum generating section 33.

The exhaust gas cleaning system having the described construction operates in a manner illustrated hereinunder. Assuming here that the diesel engine is operating, the exhaust gas emitted from the diesel engine is introduced into the case 21 through the inlet 21 of the latter, and flows through the walls of the heat-resistant filter 21 and the catalyst bed 26. Finally, the exhaust gas is discharged through the outlet 23. The smoke particles suspended by the exhaust gas are caught without fail by the heat-resistant filter 24 as the exhaust gas flows through the latter. Also, the bad smell and noxious components such as carbon monoxide and hydrocarbon are efficiently removed by the catalytic action of the catalyst bed 26 as the latter is passed by the exhaust gas.

It is to be noted that, since the smoke particles of the exhaust gas have been caught and removed completely by the filtrating action of the heat-resistant filter 24, the undesirable attaching of the smoke particles to the catalyst bed 26 is fairly avoided to ensure a good catalytic action of the catalyst bed over a long period of time.

As the amount of the smoke particles caught by the heat-resistant filter 24 is increased, the pressure differential between the inlet 22 of the case 21 and the outlet 23 of the same is increased correspondingly. This increase of the pressure differential is detected by the pressure-differential gauge (not shown). As the previously set pressure differential is reached, the pressure-differential gauge acts to start the high pressure burner. As a result, hot air is introduced into the case 21 so that the smoke particles which have been caught by the heat-resistant filter 24 is completely burnt and removed to regenerate the heat-resistant filter 24. This in turn cause a reduction of the pressure differential in the case 21, upon detect of which high pressure burner 28 is stopped. In this case, the heat radiating plate 30 is red-heated as a result of operation of the high pressure burner 28. The exhaust gas introduced through the inlet 22 is blown against the peripheral surface of the end portion of the heat radiating plate 30 and is heated by the latter as it flows spirally around the cylindrical peripheral surface of the heat radiating plate 30. This heated air then flows through the heat-resistant filter 24 to completely burn and remove the smoke particles.

Similarly, also in the case of the system shown in FIGS. 4 and 5, the pressure differential gauge (not shown) detects the clogging to actuate the low pressure burner 35. The hot air produced by the low pressure burner 35 is introduced into the case 21 due to the vacuum generated by the vacuum generating section 33, thereby to completely burn and remove the smoke particles which have been caught by the heat-resistant filter 24.

Industrial Applicability

To sum up, the present invention provides a small-sized system for cleaning the exhaust gas emitted from a diesel engine, which has a high cleaning performance and which is easy to maintain, applicable to various diesel engines such as those mounted on construction equipments and ordinary vehicles such as diesel buses and trucks, as well as to the diesel engines installed in buildings.

What is claimed is:

1. An exhaust gas cleaning system for diesel engines employing a hollow housing, said housing being provided with axially disposed inlet and outlet exhaust gas passages at respective ends of said housing; a catalytic bed; a heat resistant filter; said catalytic bed being disposed concentrically within said filter to form a combined assembly; said assembly being positioned at a downstream side within said housing to define a passage in a space between an outer surface of said assembly and an interior wall surface of said housing; wherein; said filter and catalytic bed being laminated to one another and being cylindrically shaped as a hollow assembly; a partition plate; said plate being disposed at the outlet of said assembly to form a closure for separating said inlet and outlet gas passages; a regenerating burner; said burner being affixed to said housing in air tight relation to and in proximity of said inlet passage; said assembly being subjected to hot air from said burner for burning and removing trapped particles from said filter; and said burner being ignited intermittently in response to pressure differential across said assembly due to clogging thereof, as exhaust gas passes through said filter.

2. An exhaust gas cleaning system as claimed in claim 1, wherein: said burner being ignited in response to a pressure differential between the inlet and outlet exhaust passages of said housing.

* * * * *